US006161415A

United States Patent [19]

Okumura et al.

[11] Patent Number: 6,161,415

[45] Date of Patent: Dec. 19, 2000

[54] COLD DEEP HOLE FORMING DEVICE

[75] Inventors: Tadashi Okumura; Mutsumi Kato, both of Koga-gun, Japan

[73] Assignee: Gohsyu Corporation, Shiga, Japan

[21] Appl. No.: 09/270,014

[22] Filed: Mar. 16, 1999

[30] Foreign Application Priority Data

Nov. 20, 1998 [JP] Japan ..... 10-330307

[51] Int. Cl.[7] ..... B21J 13/02

[52] U.S. Cl. ..... 72/354.2

[58] Field of Search ..... 72/354.2, 354.6, 72/354.8, 357

[56] References Cited

U.S. PATENT DOCUMENTS 2,027,922 1/1936 McNaught ..... 72/357

FOREIGN PATENT DOCUMENTS 63-30142 2/1988 Japan ..... 72/354.2

*Primary Examiner*—Lewell A. Larson

*Attorney, Agent, or Firm*—Wenderoth, Lind & Ponack, L.L.P.

[57] ABSTRACT

A cold deep hole forming device is capable of forming, by cold forging a deep hole for an involute spline, etc. with high accuracy and in a simple way, even in a member to be formed that is partially different in thickness. A supporting base 1A supports the member W to be formed and a punch 1B forms the deep hole H in the member W. A clamp holder 3 is provided on the outer circumference of the punch 1B. A clamp 2 is composed of split clamping pieces 21 disposed in the clamp holder 3. When forming deep hole H in the member W with the punch 1B, the clamping pieces 21 are made to move in the direction of the center under fluid pressure so as to constrain the member W to be formed at its outer circumference having a small diameter portion WT.

2 Claims, 3 Drawing Sheets

(A)

(B)

COLD DEEP HOLE FORMING DEVICE

BACKGROUND OF THE INVENTION

The Present Invention relates to a cold deep hole forming device, especially a cold deep hole forming device used for forming, by the method of cold forging, a deep hole for an involute spline, etc., in a member to be formed partially different in thickness.

Conventionally, formation of a deep hole for an involute spline, etc., in a member to be formed partially different in thickness is made by supporting the member to be formed on a supporting base, lowering a punch for forming the deep hole on the member to be formed from above and press fitting the punch in a prepared hole roughly formed in advance in the member to be formed, thus forming a deep hole for the involute spline, etc. in a prescribed shape in the member to be formed.

A problem with the conventional cold deep hole forming device was that, since it is designed to press fit the punch in a prepared hole roughly formed in advance in the member to be formed, in a state in which the member to be formed is supported on a supporting base, it is impossible to form the deep hole etc . . . uniformly from an end face (inlet of the hole) to an inner part, e.g. of a member W to be formed as shown in FIG. 3 (B) (FIG. 3 (B), which indicates changes in BBD (Between Ball Diameter) from the end face to the inner part of the member W to be formed with an involute spline by the conventional cold deep hole forming device, shows that the involute spline formed is of poor accuracy, deviating from the upper and lower limit values of BBD, in the range of the effective length of the spline). This is especially the case where the object member W to be formed is partially different in thickness as shown in FIG. 1 and FIG. 2, thus making it impossible to obtain formed pieces of high accuracy.

On the other hand, efforts are being made to solve this problem with a method which consists in press fitting the punch in a prepared hole, roughly formed in advance in the member to be formed, in a state in which the member to be formed is inserted in a die and constrained at its outer circumference, so as to form a deep hole for involute spline, etc. in a prescribed shape in the member to be formed. However, this method also presented problems such as seizure accidents between the punch and the member to be formed, impossibility of extraction of the formed piece from inside the die, etc., because there is no way to control the restraining force on the outer circumference of the member to be formed to a proper value.

SUMMARY OF THE INVENTION

The objective of the present invention is to provide a cold deep hole forming device capable of forming, in a simple way, by cold forging, a deep hole for an involute spline, etc. with high accuracy, even if the member to be formed has partially different thicknesses, in view of the problems of the conventional cold deep hole forming device.

To achieve the objective, the cold deep hole forming device according to the present invention is a cold deep hole forming device comprised of a supporting base to support the member to be formed and a punch for forming a deep hole in the member to be formed. A clamp holder is provided on the outer circumference of the punch. A clamp, is composed by circumferentially disposing a plurality of split clamping pieces, is disposed in the clamp holder. When forming a deep hole in the member to be formed with the punch, the clamping pieces are made to move in the direction of the center under fluid pressure so as to constrain the member to be formed at its outer circumference.[9]

According to the cold deep hole forming device of the present invention, realized in such a way as to move, when forming a deep hole with the punch in the member to be formed supported on a support base, a plurality of clamping pieces disposed in a clamp holder provided on the outer circumference of, the punch in the direction of the center under fluid pressure and restraining the member to be formed at its outer circumference, it is possible to form a deep hole for involute spline, etc. uniformly from the end face to the inner part of the member to be formed, even if the member to be formed has a partially different thickness, and thus obtain highly-accurate formed pieces.

In this case, since the movement of the clamping pieces is by fluid pressure, it becomes possible to easily control the restraining force on the outer circumference of the member to be formed at a proper value, thus improving the durability of the device without causing any friction between the punch and the member to be formed.

Moreover, after the forming, the restraint by the clamping pieces of the outer circumference of the member to be formed can be released by a simple removal of the fluid pressure. Thus makes it possible to form, by cold forging method, a deep hole for an involute spline, etc. in a simple and efficient way, without causing accidents requiring extracting formed pieces from inside the die, etc., which occur in conventional cold deep hole forming devices.

In this case, the cold deep hole forming device according to the present invention may be constructed in such a way as to move the clamping pieces in the direction of the center by forming the outer faces of the clamping pieces with a sloped face, forming the inner circumferential face of the clamp holder with which the outer face of the clamping pieces comes in contact with a similar sloped face, and moving the clamping pieces, through a fluid pressure piston, on the clamp holder formed with the sloped face.

This makes it possible to uniformly constrain the outer circumference of the member to be formed, by means of a plurality of the clamping pieces disposed in the clamp holder in such a way as to surround the outer circumference of the member to be formed and obtain highly-accurate formed pieces.

Furthermore, the inner face of the clamping pieces which come in contact with the outer face of the member to be formed may be formed with a sloped face. This makes it possible to perform forming considering distortion produced on the formed pieces in subsequent processes such as carbo-hardening, etc. to be made after the forming, thus obtaining formed pieces of high accuracy.

BRIEF DESCRIPTION OF THE DRAWINGS

FIG. 2 (B) is a plan view showing the arrangement of clamping pieces.

DETAILED DESCRIPTION OF THE INVENTION

A cold deep hole forming device according to the present invention will be explained hereafter with reference to drawings.

Figure 1:
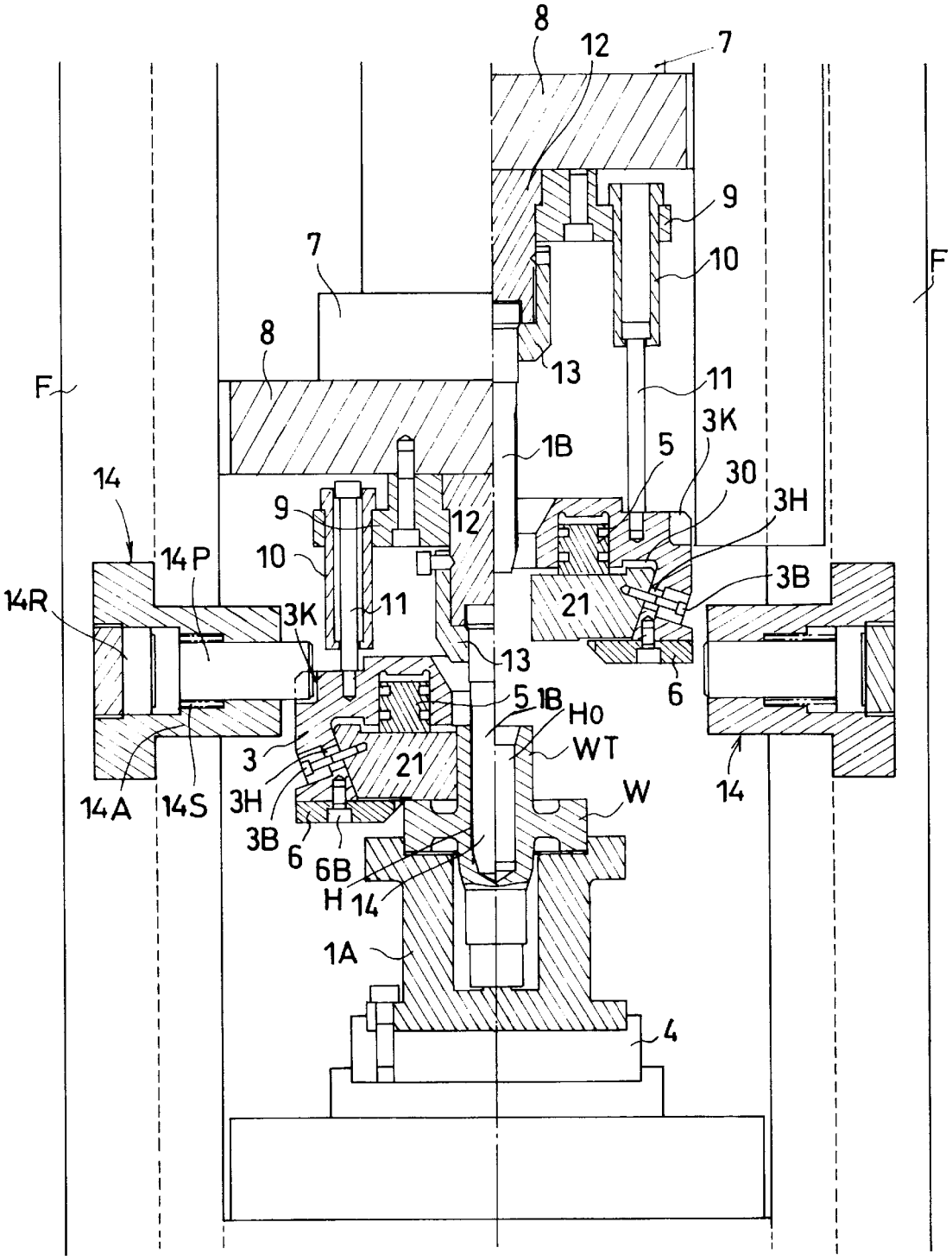
FIG. 1 is a sectional view showing an embodiment of the cold deep hole forming device according to the present invention, the drawing in the right half showing a state in which a punch is raised and the drawing in the left half showing a state in which the punch is press fit in a member to be formed.
Figure 2:
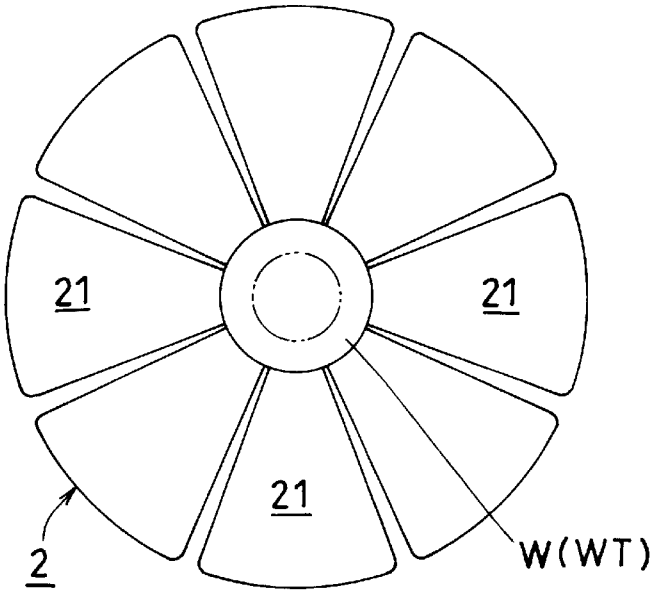
FIG. 2 (A) is a sectional view showing a clamp holder in which is disposed a clamp, the drawing in the left half showing a state in which the outer circumference of the member to be formed is constrained with clamping pieces and the drawing in the right half showing a state in which that constraint is released.
Figure 2:
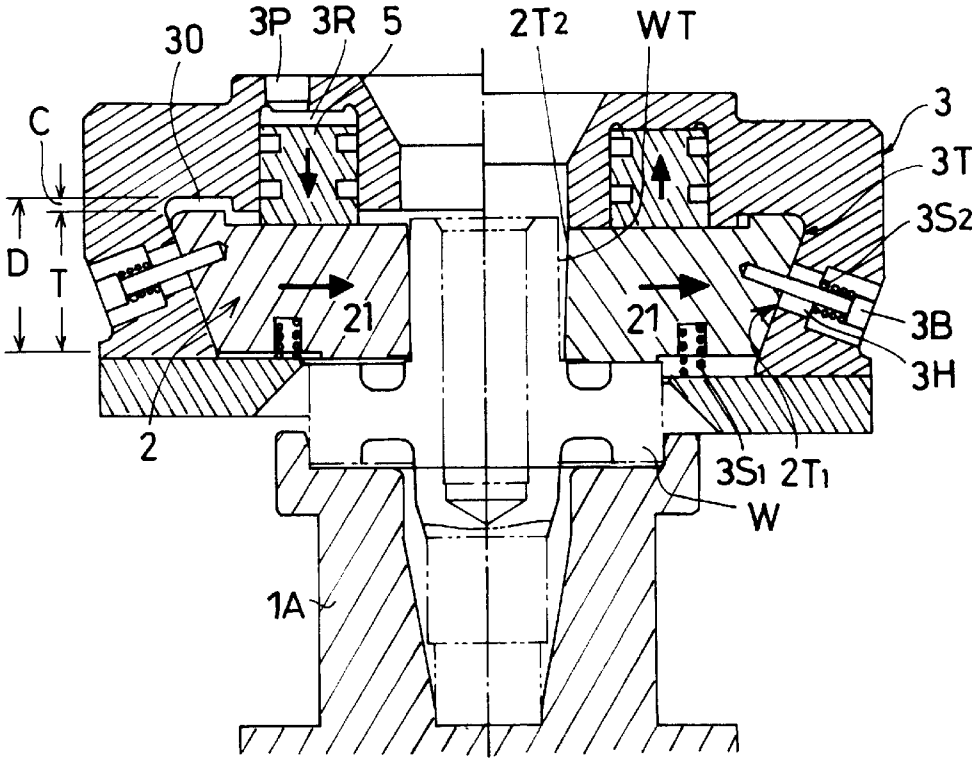

FIG. 1 and FIG. 2 indicate an embodiment of the deep hole forming device according to the present invention.

This cold deep hole forming device comprises, for example, a supporting base 1A for supporting the lower part of a member W to be formed that is partially different in thickness and a punch 1B for forming a deep hole H for an involute spline, etc. in member W. Concentrically disposed clamp holder 3 on an outer circumference of the punch 1B. A clamp 2 is composed by circumferentially disposing a plurality of split clamping pieces 21 in this clamp holder 3.

In this case, the supporting base 1A is fixed on a base 4.

On the other hand, the punch 1B—is concentrically disposed over the supporting base 1A by providing a punch clamp holder 12, through a mounting bracket 9, at the center position of a lift stand 8 attached to a ram 7. The punch 1B is fixed to punch clamp holder 12 by means of a box-nut shaped mounting fixture 13.

This makes it possible to lower the punch 1B from above on to the member W supported on the supporting base 1A by driving the ram 7, and form a deep hole H for an involute spline, etc. of a prescribed shape in the member W. The punch 1B is press fitted in a prepared hole HO roughly formed in advance in the member W.

Moreover, the clamp holder 3 is concentrically disposed around the outer circumference of the punch 1B by hanging at the bottom end of a hanging bolt 11, that is vertically guided by a supporting guide 10 disposed on the outer circumference of the mounting bracket 9 attached to the lift stand 8. On this clamp holder 3 is placed the clamp 2 constructed by circumferentially disposing the plurality of split clamping pieces 21. In this embodiment, the clamp 2 is composed of the clamping pieces 21 split into 8 parts, but the dividing number of the clamp 2 is not restricted to this number, and may also be set for an optional number such as 6 split parts, etc., for example.

The clamping pieces 21 are disposed in a clamp holding mechanism 30 of circular shape formed by the clamp holder 3 and a flange 6 fixed to the bottom face of clamp holder 3 by a bolt 6B. Clamp holding mechanism 30 is formed with a dimension D in axial direction (the direction of height in FIG. 2 (A)) larger than the thickness T of the clamping pieces 21, and is constructed such that the clamping pieces 21 may move up and down in the range of a distance C in FIG. 2 (A) in the clamp holding mechanism 30.

In this case, the clamping pieces 21 are arranged to be urged by a spring 3S1 that is interposed between the clamping pieces 21 and the flange 6.

Furthermore, to the clamping pieces 21 is fastened a bolt 3B which is inserted in a slit 3H provided in the vertical direction in the clamp holder 3 to thereby prevent the clamping pieces 21 from circumferentially moving in the clamp holding mechanism 30. A spring 3S2 disposed on the shaft of the bolt 3B keeps the outer side face 2T1 of the clamping pieces 21 in a state of contact with the inner circumferential face 3T of the clamp holder 3.

The outer side face 2T1 of the clamping pieces 21 is formed with a downward slope face, and the inner circumferential face 3T of the clamp holder 3 to be in contact with the outer side face 2T1 of the clamping pieces 21 is also formed on a downward slope face.

At the top of the clamp holder 3, forming part of the clamp holding mechanism 30, is formed an operating fluid chamber 3R of circular shape and provided with a piston 5. This makes it possible to feed operating fluid to the operating fluid chamber 3R through a port 3P, when forming a deep hole H for an involute spline, etc. in the member W, supported on the supporting base 1A by punch 1B, the piston 5 is thereby moved in the downward direction of FIG. 2 (A), which moves the clamping pieces 21 downward along the inner circumferential face 3T of the clamp holder 3 formed with a sloped face, and in the direction of the center, so as to constrain the outer circumference of a small diameter portion WT of the member W to be formed.

In case the supply of operating fluid to the operating fluid chamber 3R is interrupted, the clamping pieces 21 move in the radial direction (the direction away from the center) while moving upward along the inner circumferential face 3T of the clamp holder 3 under the action of the spring 3S1 interposed between the clamping pieces 21 and the flange 6 and the spring 3S2 disposed on the shaft of the bolt 3B fastened to the clamping pieces 21. This makes it possible to remove the constraint due to the clamping pieces 21 on the outer circumference of the small diameter portion WT of the member W to be formed.

On the body frame F is disposed a stopper 14 for controlling ascent of the clamp holder 3 when the clamp holder 3 is at the lower position. Stopper 14 is designed such that, as operating fluid is fed to an operating fluid chamber 14R formed inside the stopper body 14A fixed to the body frame F, a stopper pin 14P juts out and the tip of the stopper pin 14P is caught in the a 3K formed at the top of the clamp holder 3. This controls the ascent of the clamp holder 3. Thanks to this stopper 14, it becomes possible to control the ascent of the clamp holder 3 by engaging the tip of the stopper pin 14P with the notch 3K formed at the top of the clamp holder 3 when extracting the punch 1B from the member W to be formed by making the ram 7 go up after forming a deep hole H for an involute spline, etc. of a prescribed shape in the member W, and extract the punch 1B smoothly from the member W, because the member W is prevented from going up together with the clamp holder 3. In this embodiment, the bottom face of the clamping pieces 21 disposed on the clamp 3 holder comes in to contact with the member W to be formed.

The stopper pin 14P is constructed so as to be stored in the stopper body 14A when the supply of operating fluid to the operating fluid chamber 14R is stopped under the action of a spring 14S disposed on the shaft of the stopper pin 14P. This allows ascent of the clamp holder 3 and its descent in the subsequent process.

The actions of the cold deep hole forming device according to the present invention will be explained hereafter.

Member W to be formed, which is formed in a prescribed shape in advance by forging, etc., and having the prepared hole HO roughly formed on it, is supported on a supporting base 1A (the right half of the drawing in FIG. 1).

Next, the ram 7 is lowered, to thereby concentrically dispose the clamp holder 3 hung at the bottom end of the hanging bolt 11 and vertically guided by the supporting guide 10 disposed on the outer circumference of the mounting bracket 9 attached to the lift stand 8, around the outer circumference of the small diameter portion WT of the member W to be formed. In this state, operating fluid is fed to the operating fluid chamber 3R of the clamp holder 3 through the port 3P to thereby move the piston 5 in the downward direction and move the clamping pieces 21 downward-along the inner circumferential face 3T of the clamp holder 3 and in the direction of the center, thus constraining the outer circumference of the small diameter portion WT of the member W to be formed (left half drawing in FIG. 2 (A)).

By further lowering the ram 7, in the state in which the outer circumference of the small diameter portion WT of the member W to be formed is constrained by the clamping pieces 21, the punch 1B is made to come down from above on to the member W supported on the supporting base 1A and press fit in the prepared hole HO, roughly formed in advance in the member W to be formed, to form a deep hole H for involute spline, etc. of prescribed shape in the member W (left half drawing in FIG. 1).

As described above, by forming deep hole H for involute spline, etc. of prescribed shape in the state in which the outer circumference of the small diameter portion WT of the member W to be formed is constrained, it becomes possible to form the deep hole H for involute spline, etc. uniformly from the end face to the inner part of the member W to be formed, even in the case where the member W to be formed is partially different in thickness.

Figure 3:
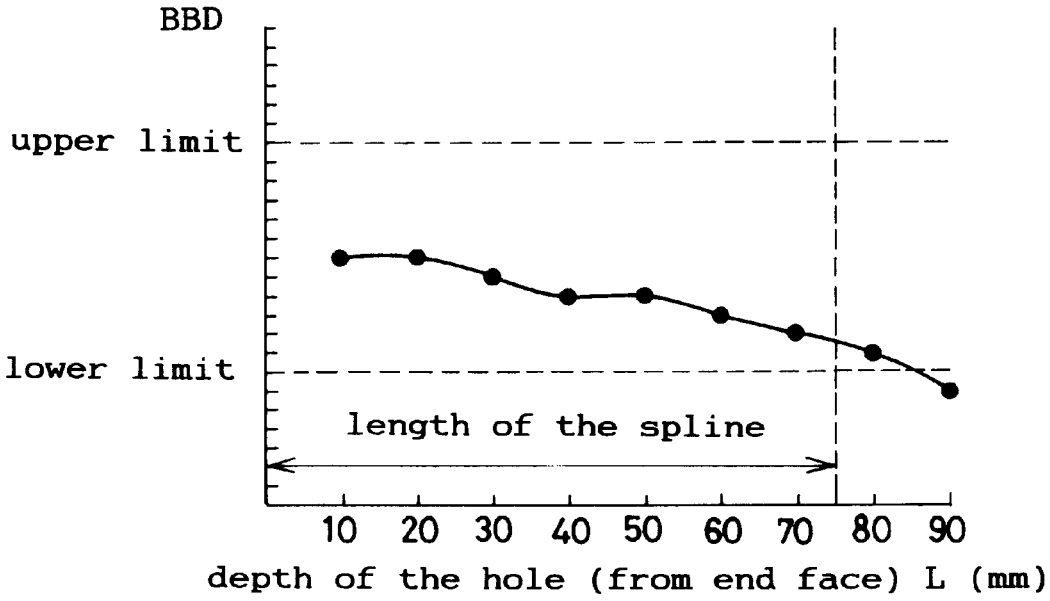
FIGS. 3 (A)–3 (B) indicate changes of BBD (Between Ball Diameter) from an end face to an inner part of a member to be formed with an involute spline on the member, 3 (A) showing a case of forming by using the cold deep hole forming device according to the present invention, and 3 (B) showing a case of forming by using a conventional cold deep hole forming device, respectively.
Figure 3:
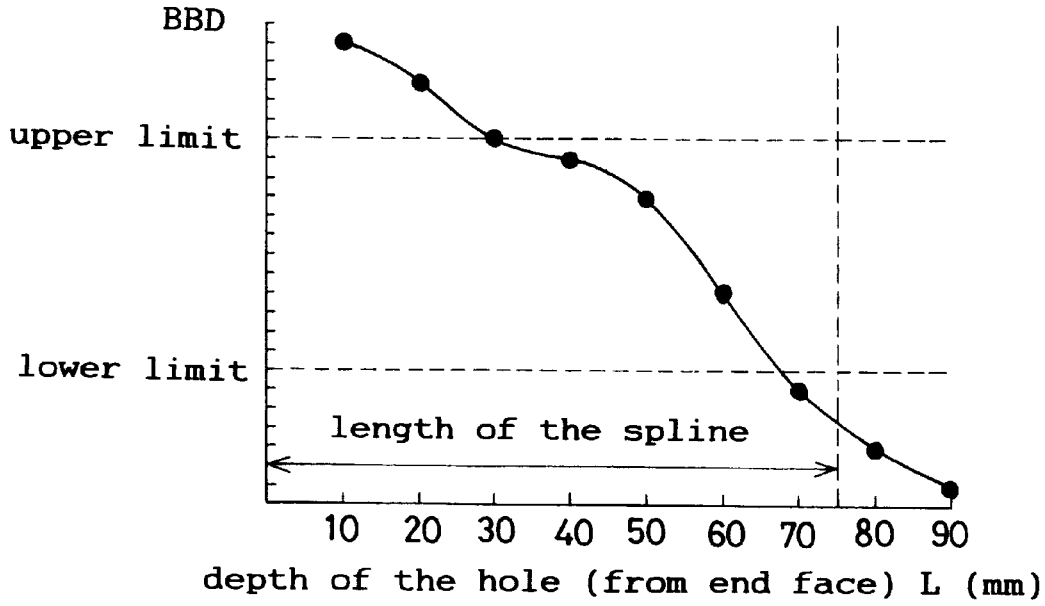

FIG. 3 (A) indicates changes of BBD (Between Ball Diameter) from the end face to the inner part of a member W to be formed with an involute spline by using the cold deep hole forming device according to the present invention, showing that the involute spline formed remains between the upper and lower limit values of BBD in the range of effective the length of the spline, thus ensuring high accuracy.

As the supply of operating fluid to the operating fluid chamber 3R is interrupted, the clamping pieces 21 move in the radial direction (the direction away from the center), while moving upward along the inner circumferential face 3T of the clamp holder 3 under the action of the spring 3S1 interposed between the clamping pieces 21 and the flange 6 and the spring 3S2 disposed on the shaft of the bolt 3B fastened to the clamping pieces 21. This removes the constraint by clamping pieces 21 on the outer circumference of the small diameter portion WT of the member W to be formed (right half drawing in FIG. 2 (A)).

In this way, after forming the deep hole H for involute an spline, etc. of a prescribed shape in the member W with the punch 1B, the ram 7 is made to go up to extract the punch 1B from the member W to be formed. At that time, as operating fluid is fed to the operating fluid chamber 14R formed inside the stopper body 14A of the stopper 14 fixed to the body frame F, the tip of the stopper pin 14P is caught in the notch 3K formed at the top of the clamp holder 3, thereby controlling ascent of the clamp holder 3, preventing the member W to be formed from going up and extracting the punch 1B from the member W.

After extraction of the punch 1B from the member W to be formed, the supply of operating fluid to the operating fluid chamber 14R formed in the stopper body 14A of the stopper 14 is stopped, and the stopper pin 14P is then stored in the stopper body 14A, removing control of the ascent of the clamp holder 3. The ram 7 is raised to make the clamp holder 3 go up and return to its initial state.

The member W in which is formed the deep hole H for involute spline, etc., supported on the supporting base 1A, is then removed to complete the forming process.

By the way, the shapes of the component parts such as supporting base 1A, punch 1B and clamping pieces 21 of the clamp 2, etc. to be installed on the cold deep hole forming device are not restricted to those indicated in the present embodiment, and other shapes suitable to the shape of the member W to be formed may also be used as required.

In addition, an inner side face 2T2 of the clamping pieces 21 for contact with the outer circumferential face of the small diameter portion WT of the member W may be formed with a slope, as required, thus making it possible to perform forming while considering distortion produced on the formed pieces in subsequent processes such as carbo-hardening, etc. and thus obtain formed pieces of high accuracy.

Especially in the case where the object member W to be formed is partially different in thickness as shown in FIG. 1 and FIG. 2, it is desirable to form such that the end face side of the small diameter portion WT of the member W to be formed is slightly larger, to compensate for the distortion produced on the formed pieces in subsequent processes such as carbo-hardening, etc., but this can be easily achieved by forming the inner side face 2T2 of the clamping pieces 21 with a downward slope.

What is claimed is:

1. A cold deep hole forming device comprising:

a supporting base for supporting a member to be formed;

a punch for forming a deep hole in the member to be formed;

a clamp holder provided outside of an outer circumference of said punch, said clamp holder having an inner circumferential sloped face and including an operating fluid reservoir and a piston disposed in said operating fluid reservoir of said clamp holder; and a clamp comprising a plurality of split clamping pieces disposed in said clamp holder, said clamping pieces having an outer sloped face for contact with said inner circumferential sloped face of said clamp holder and said clamping pieces being provided with a slope corresponding to the slope of said inner circumferential sloped face of said clamp holder, such that when a deep hole is formed in the member with said punch, fluid pressure in said operating fluid reservoir causes said piston to centrally move said clamping pieces along said inner circumferential sloped face in order to constrain the member to be formed at an outer circumference of the member.

2. The cold deep hole forming device of claim 1, wherein said clamping pieces have an inner sloped face for engaging the outer circumference of the member with said inner sloped face.

* * * * *